United States Patent [19]

VanVoorhees

[11] Patent Number: 4,531,446

[45] Date of Patent: Jul. 30, 1985

[54] MACHINE GUN ADAPTOR

[76] Inventor: Steven C. VanVoorhees, 531 S. Ridgewood Ave., Daytona, Fla. 32014

[21] Appl. No.: 401,844

[22] Filed: Jul. 26, 1982

[51] Int. Cl.[3] ..... F41C 21/10

[52] U.S. Cl. ..... 89/29; 89/145; 89/156

[58] Field of Search ..... 42/29, 77; 89/29, 128, 89/141, 145, 156

[56] References Cited

FOREIGN PATENT DOCUMENTS 662545 8/1929 France ..... 42/77

103258 12/1941 Sweden ..... 89/29

*Primary Examiner*—Stephen C. Bentley

*Attorney, Agent, or Firm*—Duckworth, Allen, Dyer, & Pettis

[57] ABSTRACT

An apparatus for converting an automatic firearm of high caliber including a frame, a receiver mounted on the frame, a barrel mounted on the receiver, a bolt disposed on the receiver telescopically moveable relative to the breech end of the barrel against the action of a recoil spring, and the bolt being controlled by a sear which is movable in response to the movement of the weapon trigger and a disconnect lever, to a low caliber automatic firearm is disclosed. The apparatus for conversion includes a frame disposed in the receiver of the firearm, a low mass bolt assembly including a bolt carrier, a bolt, and a sear foot disposed in sliding contact with the frame. A pivotable camming lever is attached to the frame and pivots in response to impact from the bolt carrier. The camming lever provides sufficient mechanical advantage to enable the forward impact of the low mass bolt assembly to depress the disconnect lever on the original weapon. A conversion barrel is provided and a floating chamber is also provided to enhance the recoil power of the low caliber round.

13 Claims, 9 Drawing Figures

MACHINE GUN ADAPTOR

BACKGROUND OF THE INVENTION

This invention relates in general to submachine guns or machine pistols and more particularly to a conversion apparatus to convert the typical .45 and .38 caliber submachine gun into a submachine gun that can fire .22 caliber rounds.

Submachine guns or machine pistols are characterized by their lightweight and compact construction. Many such machine guns are currently produced. For example, the M.A.C. 10 and 11, the Uzi submachine and others of similar construction. One such weapon is described in U.S. Pat. No. 3,651,736 (Ingram). One of the disadvantages of the submachine guns of this type is that they fire large caliber rounds such as .45 and .38 caliber and are therefore expensive to operate. The expense becomes substantial when it is realized that a person being trained in the operation of the weapon will fire large numbers of rounds during training Therefore, there has been a need until presently for an efficient conversion of an automatic machine gun or machine pistol to fire smaller caliber rounds such as .22 caliber long rifle rounds.

SUMMARY OF THE INVENTION

The conversion apparatus of the present invention is characterized by a conversion frame disposed in the receiver of an automatic firearm; coupled to a sliding low mass bolt assembly including a bolt carrier, a bolt, and a sear foot disposed on the bolt carrier. A conversion barrel is inserted inside the barrel of the existing gun and attached thereto. The recoil of the low caliber round is enhanced by providing a floating chamber in cooperation with the conversion barrel. A further feature of the invention is a camming lever disposed on the conversion frame so that it can be impacted by the bolt carrier. The pivotable camming lever is disposed in contact with the disconnect lever of the original weapon and is designed so that the impact of the bolt carrier on the camming lever provides mechanical advantage thereby creating a resultant force on the disconnect lever that is greater than the force that would be provided by impact of the bolt carrier alone.

BRIEF DESCRIPTION OF THE DRAWINGS

Further details are explained below with the help of the examples illustrated in the attached drawings in which.

DETAILED DESCRIPTION OF THE INVENTION

Figure 1:
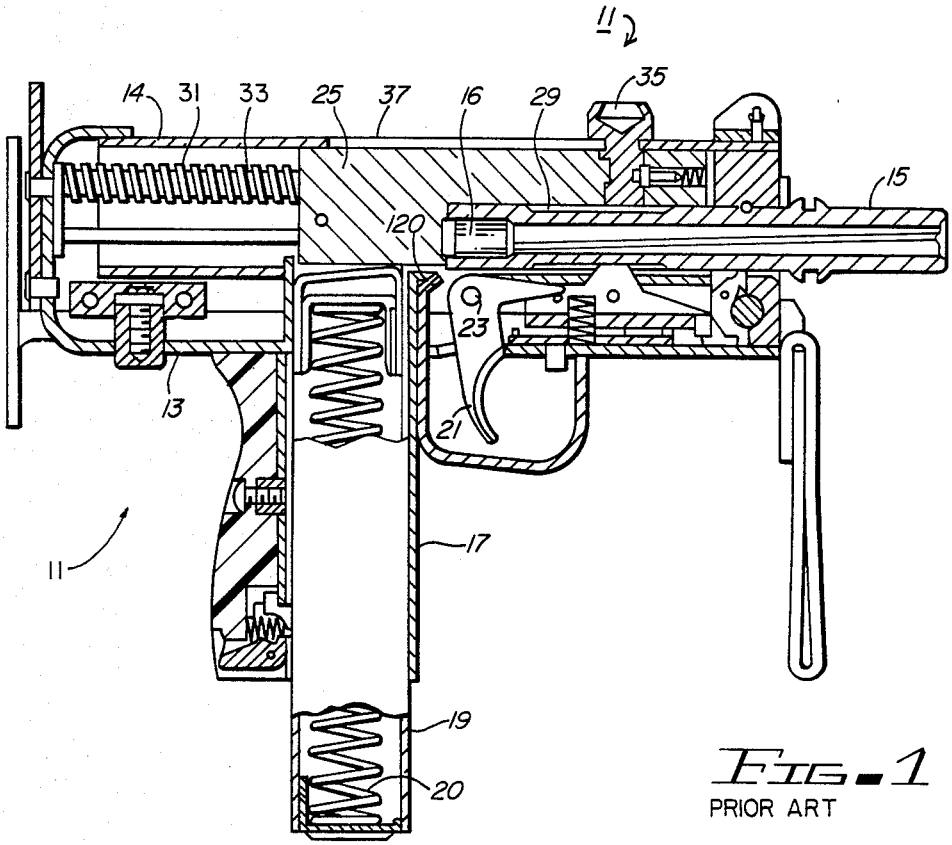
FIG. 1 PRIOR ART
FIG. 1 is a cross sectional side view of a standard submachine gun.

Illustrated in FIG. 1 is a weapon 11 of the submachine gun or machine pistol type. The weapon is characterized by a frame 13 supporting receiver section 14 which includes a barrel 15 usually with a bore .38 or .45 caliber. The barrel 15 is provided with a breech portion 16. The weapon 11 also includes a magazine housing 17 into which is disposed a magazine 19 with an associated spring 20. A trigger 21 is provided pivotally mounted to a pin 23 secured to the frame 13. The weapon 11 also includes a bolt 25 slideably mounted within the receiver 14. The bolt 25 is provided with a centrally disposed cavity 29 into which the barrel 15 is disposed when the bolt 25 is in its uncocked position. The bolt 25 is biased to the uncocked position by a recoil spring 31 disposed about a rod 33 which is received within a cylindrical opening in the bolt 25 so that the rod 33 is slideably coupled to the bolt 25. A handle 35 is pivotally connected to the bolt 25 and is disposed within an opening 37 in the receiver 14. The handle 35 provides a means for cocking the bolt 25 to prepare the weapon 11 for firing. Cocking is accomplished by pulling on the handle 35 and sliding the handle 35 along opening 37 in the receiver 14.

Figure 8:
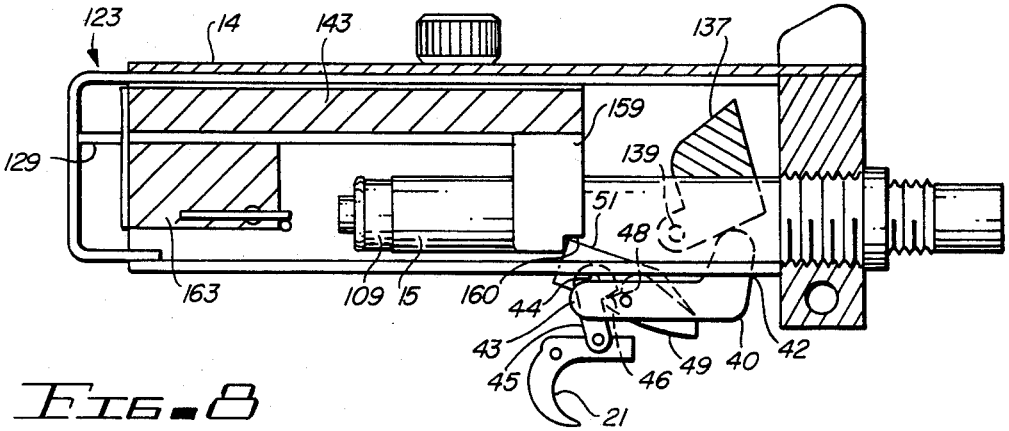
FIG. 8 is a cross sectional side view showing a submachine gun with the conversion mechanism of the present invention.

Many of the weapons 11 of the type described herein above include a disconnect lever which enables the weapon 11 to be fired in a semiautomatic mode. The function of the disconnect lever 40 is best illustrated in FIG. 8. The disconnect lever 40 is an L-shaped member pivotally connected to the frame 13 of the weapon 11. The disconnect lever 40 includes a foot section 42 which is disposed in the path of the bolt 25 of the original weapon 11. The disconnect lever 40 also includes a cam surface 43 which is disposed to engage a pin 44 on a trip lever 45. The trip lever 45 is connected at the bottom end to the trigger 21. The upper end of the trip lever 45 includes a pointed section 46 which is adapted to engage a projection 48 on sear 49. The projection 48 and the pointed section 46 are shown in phantom in FIG. 8. The sear 49 is also pivotally mounted on the frame 13 and includes a rear portion 51 which in the original weapon 11 is adapted to engage a forward portion of the bolt 25 (see FIG. 1). The disconnect lever 40 enables the parent gun to be fired in a semiautomatic mode as follows. As the weapon is fired, trigger 21 pivots causing trip lever 45 to move downward thereby engaging the projection 48 on the sear 49. The sear 49 is caused to pivot and move out of the path of the bolt 25. The spring 31 then causes the bolt to move forward to fire a round. As the bolt moves forward in the original weapon 11 the leading edge of the bolt will engage the foot 42 of the disconnect lever 40, causing the disconnect lever to pivot and causing cam surface 43 to force pin 44 on the trip lever 45 to move upwards and laterally. This action frees the sear 49, which upon the recoil of the bolt 25, will be placed once again in the path of the bolt 25 thereby restraining it in the cocked position. An adequate conversion of the weapon from a large caliber to a small caliber barrel must compensate for the required force that has to be applied to the disconnect lever 40 by a lighter conversion bolt, in order to allow the weapon 11 to be fired in a semiautomatic mode. As described herein, below and shown in FIG. 8 the conversion apparatus of the present invention achieves the purpose without modifying the disconnect lever 40, the trigger 21, the sear 49 or the trip lever 45.

Figure 2:
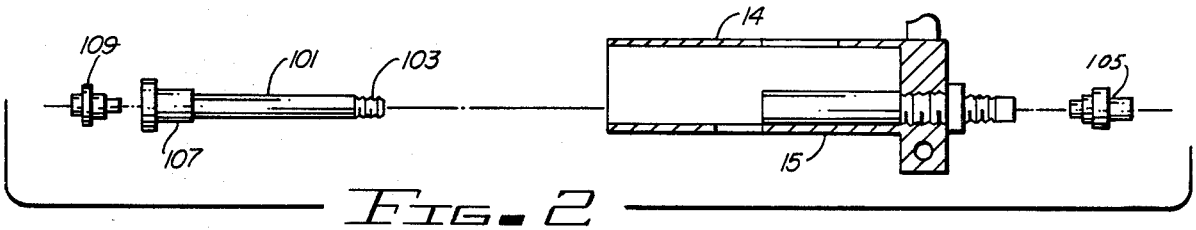
FIG. 2 is a side view of the conversion barrel components.

The conversion apparatus includes a conversion barrel 101 (shown in FIG. 2) having an external diameter capable of being inserted into the barrel 15 with close tolerances. The internal diameter of the conversion barrel is .22 caliber. The conversion barrel 101 includes a threaded front portion 103 which, when inserted through the barrel 15 protrudes past the end of the bell. A nut 105 is provided to secure the conversion barrel 101 to the barrel 15 at the threaded portion 103. The conversion barrel 101 is also provided with a cylindrical end portion which is sized to fit into the breech portion 16 of the barrel 15 as best seen in FIG. 3.

Figure 3:
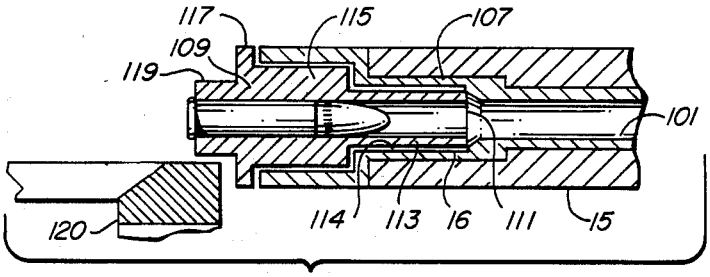
FIG. 3 is a cross sectional side view of the conversion barrel and floating chamber of the present invention.
Figure 6:
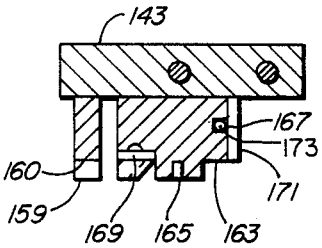
FIG. 6 is a front view of the conversion bolt assembly.

The conversion apparatus also includes a floating chamber 109 better illustrated in FIG. 3. The floating chamber 109 is a cylindrical metal piece having a .22 caliber cylindrical opening 111. Floating chamber 109 also includes a forward cylindrical portion 113 which fits into the interior portion of the cylindrical end portion 107 of the conversion barrel 109. The fit of the forward cylindrical portion 113 into the cylindrical end portion 113 is loose, i.e. there is a gap 114. The floating chamber 109 also includes a central body portion 115 which is also cylindrical and contiguous with a flange 117. The floating chamber 109 also includes a rear cylindrical portion 119 contiguous with flange 117. The floating chamber 109 is similar to that in use in the colt .22 LR conversion of the 1911 .45 caliber pistol and the .22 LR conversion for the Browning 1919 A-6 light machine gun. The floating chamber 109 performs essentially as a piston slideably mounted on the cylindrical end portion of the conversion barrel 101. When a .22 round is fired, gas at chamber pressure is released into the gap 114 between the conversion barrel 101 and the floating chamber 109 and acts to push the piston which contains the .22 caliber chamber, back with greater force than would normally be associated with the explosion of a .22 long rifle cartridge in a conventional chamber. This augmented recoil is necessary in the conversion of a submachine gun because the normal .22 LR recoil is inadequate to supply the energy required to strip a .22 LR round from a magazine, chamber and fire it, and still ride down the stiff disconnect mechanism used in the submachine gun. Travel of the floating chamber 109 is arrested by the feed ramp 120 which may be a portion of the conversion frame assembly as shown in FIG. 3, or the trigger guard as shown in FIG. 1.

The main component of the conversion apparatus includes a conversion frame 123 and a conversion bolt assembly 125 disposed within the receiver 14. The conversion frame 123 includes an opening 127 similar to the opening 37 in the original weapon 11. The conversion frame 123 also has an L-shaped rider piece 129 on which the conversion bolt assembly 125 can slide freely. A floor plate 131 is also provided in a lower portion of the conversion frame 123. The floor plate 131 has an opening 133 through which the .22 caliber rounds are fed into the weapon. A frame arm 135 is provided on the side of the frame and is adapted to support a disconnect camming lever 137 pivotally mounted on camming lever pin 139. The function of the disconnect camming lever 137 is explained in greater detail below.

The conversion bolt assembly includes a bolt carrier 143 which is adapted to slideably engage rider 129. The handle 35 from the parent weapon 11 is disposed through an opening 145 disposed on the bolt carrier 143.

Figure 5:
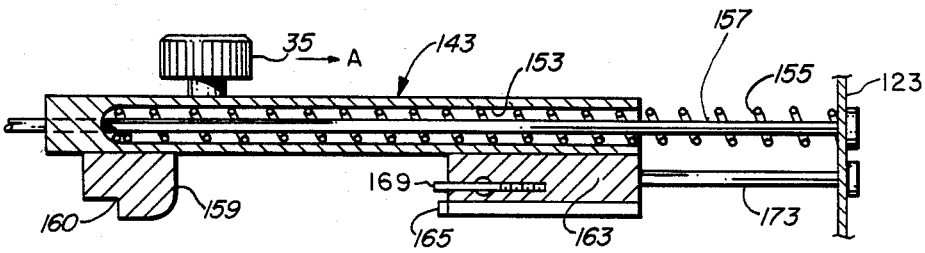
FIG. 5 is a cross sectional side view through the conversion bolt assembly of the present invention.
Figure 4:
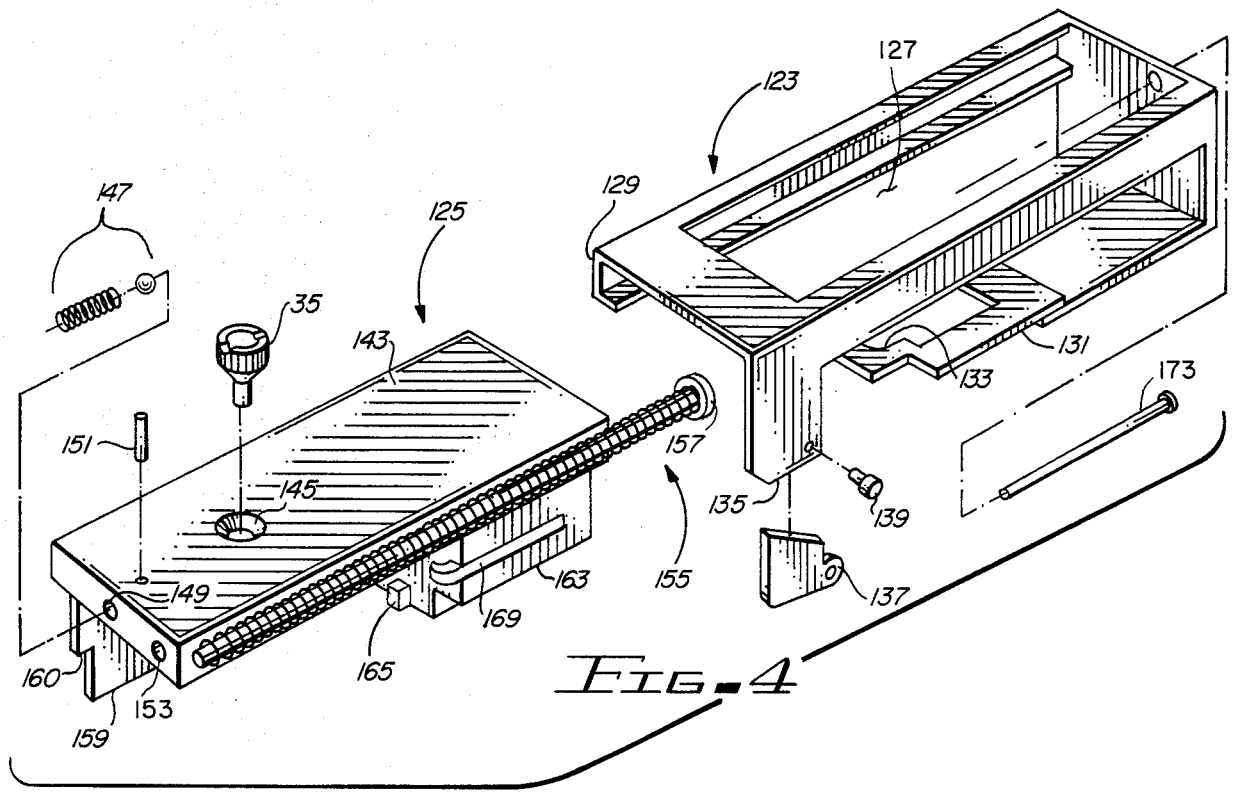
FIG. 4 is an exploded perspective view of the conversion frame and the conversion bolt assembly of the present invention.

The handle 35 is secured on the bolt carrier 143 by a cocking handle detent ball and spring 147 disposed through a hole 149 and maintained in place by detent retaining pin 151. As illustrated in FIGS. 4 and 5 the bolt carrier 143 is provided with a longitudinal opening 153 through the entire length of bolt carrier 143. An operating spring 155 is disposed around a guide rod 157 and is inserted in the longitudinal opening 153. Guide rod 157 is anchored in the rearward end wall of frame 123 as shown in FIG. 5. Disposed towards the forward end of the bolt carrier 143 is a sear foot 159 which comprises a downward plate projection having an indentation 160 on its forward edge.

Figure 7A:
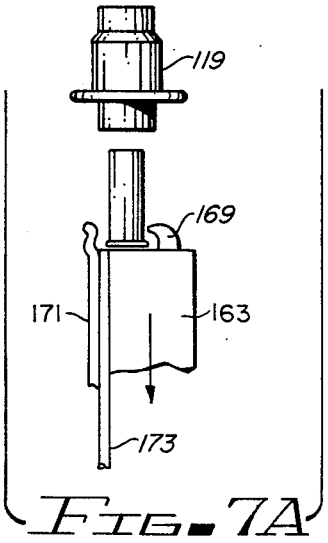
FIGS. 7*a* and 7*b* are sequential top view of the ejection mechanism of the present invention.
Figure 7B:
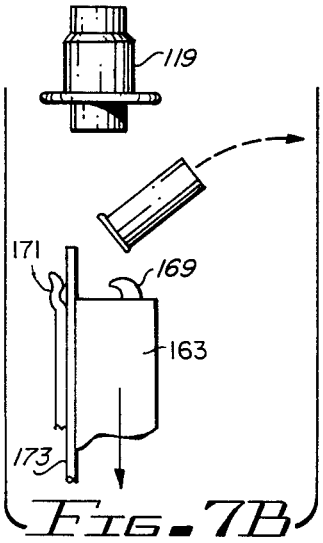

The bolt assembly 125 also includes a bolt face block 163 which is rigidly attached to the bolt carrier 143. The bolt face block 163 includes a firing pin 165 formed on its forward face and a longitudinally disposed slot 167 extending through the length of the bolt face block 163. Also disposed on the bolt face block 163 is an extractor 169 which is in the form of a hook as shown in FIG. 7. An extractor assist spring 171 is disposed along the opposite side of the bolt face block 163 to assist the extractor 169 in its operation.

The operation of the converted weapon 11 is similar in many respects to the original weapon (see FIG. 8). The weapon is cocked by pulling handle 35 rearward in the direction of arrow A of FIG. 5 compressing spring 155 until the latch or near portion 51 of the sear 49 of the original gun 11 engages the indentation 160 of the sear foot 159. At this point the gun is cocked. A round is pushed upwardly through the opening 133 on the floor plate 131 of the conversion frame 123 by spring 20 in the magazine 19. When the trigger is pulled, the rear portion 51 of the sear 49 disengages from the sear foot 159 and the conversion bolt assembly 125 is propelled forward by the operating spring 155. The bolt face block 163 operates in the same fashion as the block 25 in the original weapon to push a round of ammunition upwardly and towards the floating chamber 109. The round will be pushed into position in the cylindrical opening 111 of the floating chamber 109, and the floating chamber and the round will be pushed into the cylindrical end portion (breech portion) 107 of the conversion barrel 101. At that point, the firing pin 165 on the bolt face block 163 will contact the cap portion of the round with sufficient impact to fire the round. When the round is fired, gas at chamber pressure is released into the gap 114 between the conversion barrel 101 and the floating chamber 109, causing the floating chamber to act as a piston and be driven backwards with greater energy than the normal recoil of a .22 caliber round. The rearward impulse of the floating chamber 109 will transfer sufficient momentum to the conversion bolt assembly 125 to drive it backwards to the same position as when it was originally cocked. The rearward motion of the floating chamber 109 is arrested by the forward part of the cartridge feed ramp 120 (shown in FIG. 3). The rearward stroke of the floating chamber 109 on firing is about $\frac{1}{8}''$.

As the conversion bolt assembly 125 begins its rearward stroke it is necessary for the spent cartridge to be ejected. As shown in FIG. 7 this is accomplished by means of an extractor 169 and an ejector rod 173. As the round is fired, the floating chamber 109 and spent cartridge move in a rearward direction until the floating chamber 109 encounters the feed ramp 120 and its motion is arrested. The spent cartridge continues its rearward motion and is engaged by the extractor 169 and the extractor assist spring 171. As the conversion bolt assembly 125 continues its rearward motion the ejector rod (which remains stationary) pushes through slot 167 and exerts a forward force on the spent cartridge. The uneven force created by ejector rod 173 on the side of the spent cartridge, and the locking effect of the extractor 169 serve to provide angular momentum to the spent cartridge so that it is flipped out of the gun.

The operation of the disconnect camming lever 137 is best illustrated by reference to FIG. 8. Illustrated in FIG. 8 is a disconnect lever 40 of the parent gun described above. The disconnect lever 40 of the parent gun includes a foot 42 which projects up into the path of the bolt 25 of the original weapon 11 when the weapon is set on semi-automatic. The disconnect lever 40 is depressed by the original bolt 25 and serves to release the sear 49 of the original gun so as to engage the bolt 25 when it recedes back to the cocking position. The lever 40 is extremely stiff and is pushed down by the kinetic energy imparted to it by the original bolt 25. When the conversion is made, the conversion bolt assembly 125 cannot provide sufficient kinetic energy to depress the disconnect lever 40. In order to gain a mechanical advantage the disconnect camming lever 137, which is an L-shaped member is disposed in the path of the bolt carrier 143 of the conversion bolt assembly 125. As illustrated in FIG. 8, the disconnect camming lever 137 has an inclined portion which acts as a cam when the bolt carrier 143 moves towards the firing position. The pivoting of the disconnect camming lever 137 at pin 139 provides the mechanical advantage necessary to depress the disconnect lever 40. Thus, as the bolt carrier 143 engages the inclined portion of the camming lever 137 it creates a movement about the pin 139. The movement is resisted by the foot portion 42 of the disconnect lever 40 which is closer to the pin 139. The resultant force on the foot 42 is therefore greater than the force on the camming lever 137. The resultant force causes disconnect lever 40 to pivot thereby causing trip lever 45 to disengage from projection 48 on the sear 49. This action releases the sear 49 which is upwardly biased, so that it can engage sear foot 159 before the weapon can fire again.

Thus, the conversion requires two special measures necessary to supply the weapon with enough force to operate the disconnect of the parent gun. The first was the floating chamber 109 which substantially augments the recoil of the cartridge thus allowing the use of a heavier bolt mechanism. The second provision was the disconnect camming lever 137 which is provided to transmit the energy from the forward stroke of the conversion bolt carrier 143 to provide a mechanical advantage sufficient to disengage the disconnect lever 40 of the parent gun.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawings shall be interpreted as illustrative and not in a limiting sense.

I claim:

1. An apparatus for converting a high caliber machine pistol of the type having a frame, a receiver mounted on the frame, a barrel mounted on the receiver and a sear movable in response to a weapon trigger, to a low caliber machine pistol comprising:

a conversion frame disposed on said receiver said conversion frame having a rider portion extending longitudinally at one side thereof and having a downwardly disposed arm portion;

a bolt carrier slideably disposed on the rider portion of said conversion frame;

a bolt mounted on said bolt carrier;

recoil spring means disposed in said conversion frame for biasing said bolt carrier in a forward position;

a sear foot attached to the bolt carrier said sear foot including an indentation adapted to engage the sear of the machine pistol; and floating chamber means coupled to the barrel for augmenting recoil force on the bolt when the weapon is fired.

2. The apparatus of claim 1 further comprising:

a conversion barrel having an inside diameter capable of firing a low caliber round and an outside diameter slightly less than the inside diameter of the barrel; and means for attaching the conversion barrel to the barrel.

3. The apparatus of claim 2 wherein said barrel includes a breech portion and said conversion barrel is longer than the barrel and includes an externally threaded forward portion and a rear breech portion with an external diameter greater than the internal diameter of the barrel.

4. The apparatus of claim 3 wherein said means for attaching comprises:

an internally threaded nut disposed on said externally threaded portion.

5. The apparatus of claim 3 wherein said rear breech portion on said conversion barrel has a first portion with a first breech diameter greater than the internal diameter of the conversion barrel; and a second rear portion with a second breech diameter greater than said first breech diameter.

6. The apparatus of claim 5 wherein said floating chamber means comprises:

a cylindrical member having an internal diameter of said small caliber, a forward portion with an external diameter that is less than said first breech diameter whereby a substantial gap is provided, said cylindrical member having a central portion with an external diameter that is less than the second breech diameter, and a flange portion with a diameter greater than the second breech diameter.

7. An apparatus for converting a high caliber machine pistol of the type having a frame, a receiver mounted on the frame, a barrel mount on the receiver, a sear movable in response to a weapon trigger, and a disconnect lever for releasing the sear when the weapon is fired, to a low caliber machine pistol comprising:

a conversion frame adapted to be disposed in said receiver;

a low mass bolt assembly slidably disposed within said conversion frame;

means for biasing said bolt assembly in a forward direction; and a pivotable camming lever coupled to said conversion france and movable in response to an impact of the low mass bolt assembly, said pivotable camming lever being disposed in contact with the disconnect lever at a point a predetermined distance from the pivot point of the camming lever, and said camming lever having a cam surface adapted to be impacted by the low mass bolt assembly at a point of impact disposed a distance from the pivot point which is substantially greater than the distance from the pivot point to the point of contact of the camming lever to the disconnect lever.

8. The apparatus of claim 7 further comprising:

floating chamber means coupled to the barrel for augmenting the recoil force of the low mass bolt assembly when the weapon is fired.

9. The apparatus of claim 8 further comprising:

a conversion frame disposed in said receiver, said conversion frame including a longtiduinally disposed rider and a downwardly disposed forward leg member.

10. The apparatus of claim 9 wherein said low mass bolt assembly comprises:

a bolt carrier disposed in sliding contact with said rider; and a bolt rigidly attached to said bolt carrier.

11. The apparatus of claim 10 wherein said bolt carrier comprises a low mass rectangular plate member, and wherein said bolt carrier is adapted to impact on the upper surface of the camming member whereby the disconnect lever can be depressed.

12. The apparatus of claim 11 further comprising:

a conversion barrel having an internal diameter of low caliber and an external diameter substantially equal to the internal diameter of the barrel; and means for rigidly attaching the conversion barrel to the barrel.

13. The apparatus of claim 12 wherein said rectangular bolt carrier includes a longitudinally disposed opening;

wherein said recoil spring means for biasing comprises a shaft disposed through said longitudinal opening; and a spring wound around said shaft.

* * * * *